US011092919B1

(12) United States Patent
Miyata et al.

(10) Patent No.: US 11,092,919 B1
(45) Date of Patent: Aug. 17, 2021

(54) HEATING DEVICE AND IMAGE FORMING APPARATUS

(71) Applicant: FUJIFILM Business Innovation Corp., Tokyo (JP)

(72) Inventors: Toshiyuki Miyata, Kanagawa (JP); Toru Inoue, Kanagawa (JP); Kazuyoshi Itoh, Kanagawa (JP); Toko Hara, Kanagawa (JP); Motoharu Nakao, Kanagawa (JP); Sou Morizaki, Kanagawa (JP); Kiyoshi Koyanagi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/920,733

(22) Filed: Jul. 5, 2020

(30) Foreign Application Priority Data

Mar. 27, 2020 (JP) ..... JP2020-058592

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2039; G03G 15/2046; G03G 15/2053; G03G 2215/2003
See application file for complete search history.

(56) References Cited

U.S. PATENT DOCUMENTS 6,339,211 B1 * 1/2002 Foote ..... G03G 15/2064 118/60

FOREIGN PATENT DOCUMENTS

JP 2013142834 7/2013

* cited by examiner

*Primary Examiner* — Thomas S Giampaolo, II
(74) *Attorney, Agent, or Firm* — JCIPRNET

(57) ABSTRACT

A heating device includes a rotating unit, a transport belt, a heater, and at least one heat pipe. The rotating unit rotates. The transport belt rotates together with the rotating unit while nipping a heated member together with the rotating unit so as to transport the heated member. The heater has a contact surface in contact with an inner peripheral surface of the transport belt and a non-contact surface not in contact with the inner peripheral surface of the transport belt, and generates heat so as to heat the heated member via the transport belt. The heat pipe is disposed in an oblique direction relative to a belt width direction of the transport belt such that the heat pipe is in contact with the non-contact surface of the heater, and transfers heat in the oblique direction in accordance with a function of a working fluid enclosed inside the heat pipe.

15 Claims, 8 Drawing Sheets

HEATING DEVICE AND IMAGE FORMING APPARATUS

CROSS-REFERENCE TO RELATED APPLICATIONS

This application is based on and claims priority under 35 USC 119 from Japanese Patent Application No. 2020-058592 filed Mar. 27, 2020.

BACKGROUND

(i) Technical Field

The present disclosure relates to heating devices and image forming apparatuses.

(ii) Related Art

Japanese Unexamined Patent Application Publication No. 2013-142834 discloses an image forming apparatus that causes a heated member to pass through a fixation nip formed by a heater, a film member rotatably disposed in pressure contact with the heater, and a presser disposed in pressure contact with the heater with the film member interposed therebetween. In this image forming apparatus, the heater is a plate-like heat pipe, a heating element is printed on the fixation-nip-facing surface of a heat pipe substrate with an insulation layer interposed therebetween, and the outermost surface is coated with the insulation layer.

SUMMARY

In a conceivable configuration that uses a heater to heat a heated member, transported by a rotating unit and a transport belt, via the transport belt, a heat pipe is used to transfer heat from a high temperature section to a low temperature section of the heater (referred to as "configuration A" hereinafter).

In the aforementioned configuration A, if the heat pipe is disposed to extend in the belt width direction of the transport belt, temperature variations tend to occur in the heater in the belt circumferential direction of the transport belt.

Aspects of non-limiting embodiments of the present disclosure relate to reducing temperature variations in a heater in the belt width direction and the belt circumferential direction, as compared with a configuration where a heat pipe is disposed to extend in the belt width direction of a transport belt.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including a rotating unit, a transport belt, a heater, and at least one heat pipe. The rotating unit rotates. The transport belt rotates together with the rotating unit while nipping a heated member together with the rotating unit so as to transport the heated member. The heater has a contact surface in contact with an inner peripheral surface of the transport belt and a non-contact surface not in contact with the inner peripheral surface of the transport belt, and generates heat so as to heat the heated member via the transport belt. The at least one heat pipe is disposed in an oblique direction relative to a belt width direction of the transport belt such that the at least one heat pipe is in contact with the non-contact surface of the heater, and transfers heat in the oblique direction in accordance with a function of a working fluid enclosed inside the at least one heat pipe.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the drawings.

Image Forming Apparatus 10

Figure 1:
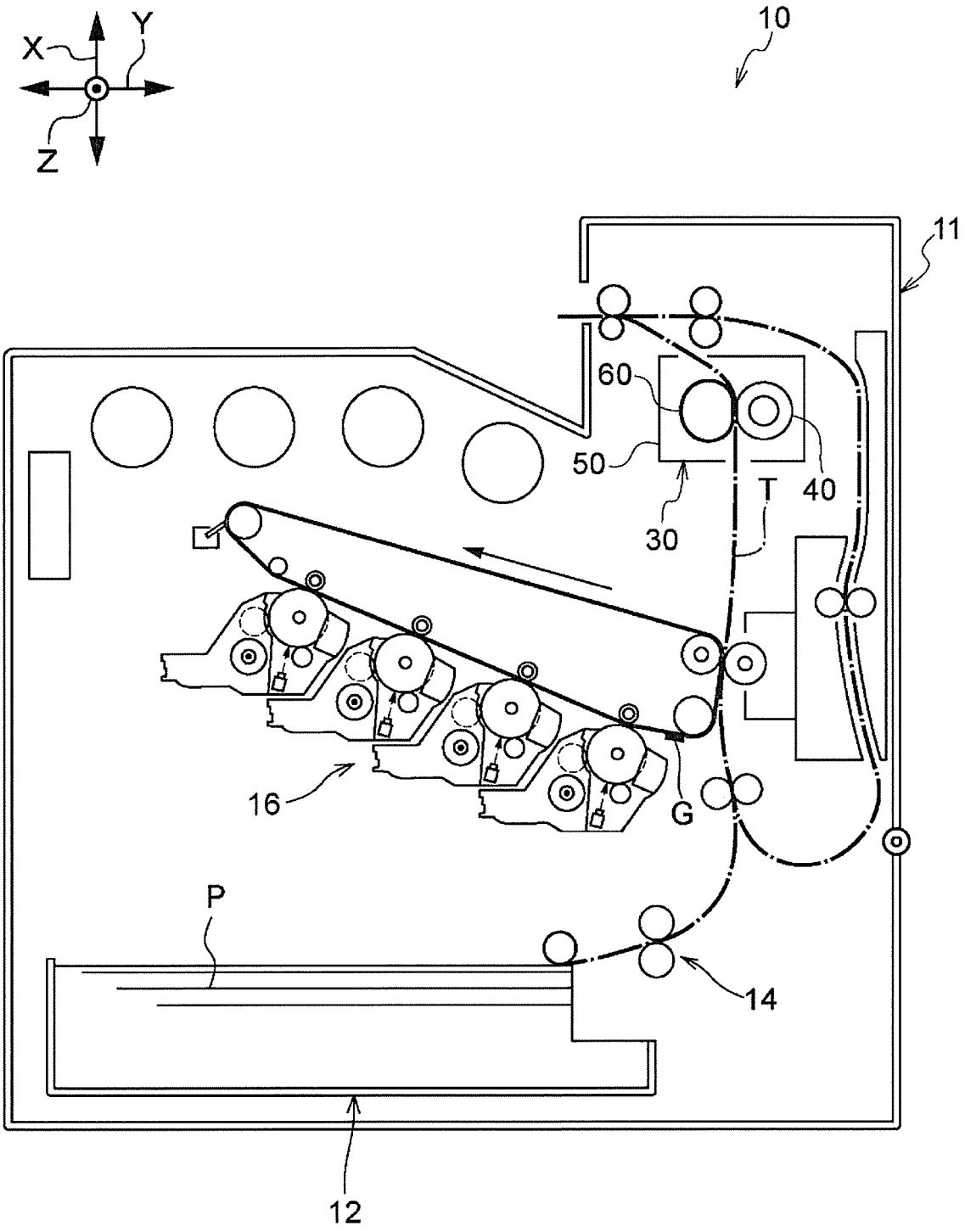
FIG. 1 schematically illustrates the configuration of an image forming apparatus according to this exemplary embodiment.

The configuration of an image forming apparatus 10 according to an exemplary embodiment will now be described. FIG. 1 schematically illustrates the configuration of the image forming apparatus 10 according to this exemplary embodiment. In the following description, the height direction, the depth direction, and the left-right direction of the image forming apparatus 10 will be referred to as, "apparatus height direction", "apparatus depth direction", and "apparatus width direction", respectively. The apparatus height direction, the apparatus depth direction, and the apparatus width direction are orthogonal to one another. In the drawings, the apparatus height direction is indicated by an arrow X, the apparatus depth direction is indicated by an arrow Z, and the apparatus width direction is indicated by an arrow Y. Because these directions are defined for the sake of convenience, the apparatus configuration is not to be limited to these directions.

As shown in FIG. 1, the image forming apparatus 10 includes an apparatus body 11, a container 12 that contains at least one sheet P, a transport unit 14 that transports the sheet P, an image forming unit 16 that forms a toner image G onto the sheet P, and a fixing device 30.

The sheet P is an example of a recording medium as well as a heated member. The toner image G is an example of an image. The image forming unit 16 is an example of an image forming unit. The transport unit 14 transports the sheet P upward from the container 12 in the apparatus height direction along a transport path T. For example, the image forming unit 16 performs a known electrophotographic process including an electrostatic charging step, an exposure step, a developing step, and a transfer step by using a single-color toner or multicolor toners, so as to form the toner image G onto the sheet P transported by the transport unit 14.

Fixing Device 30

Figure 2:
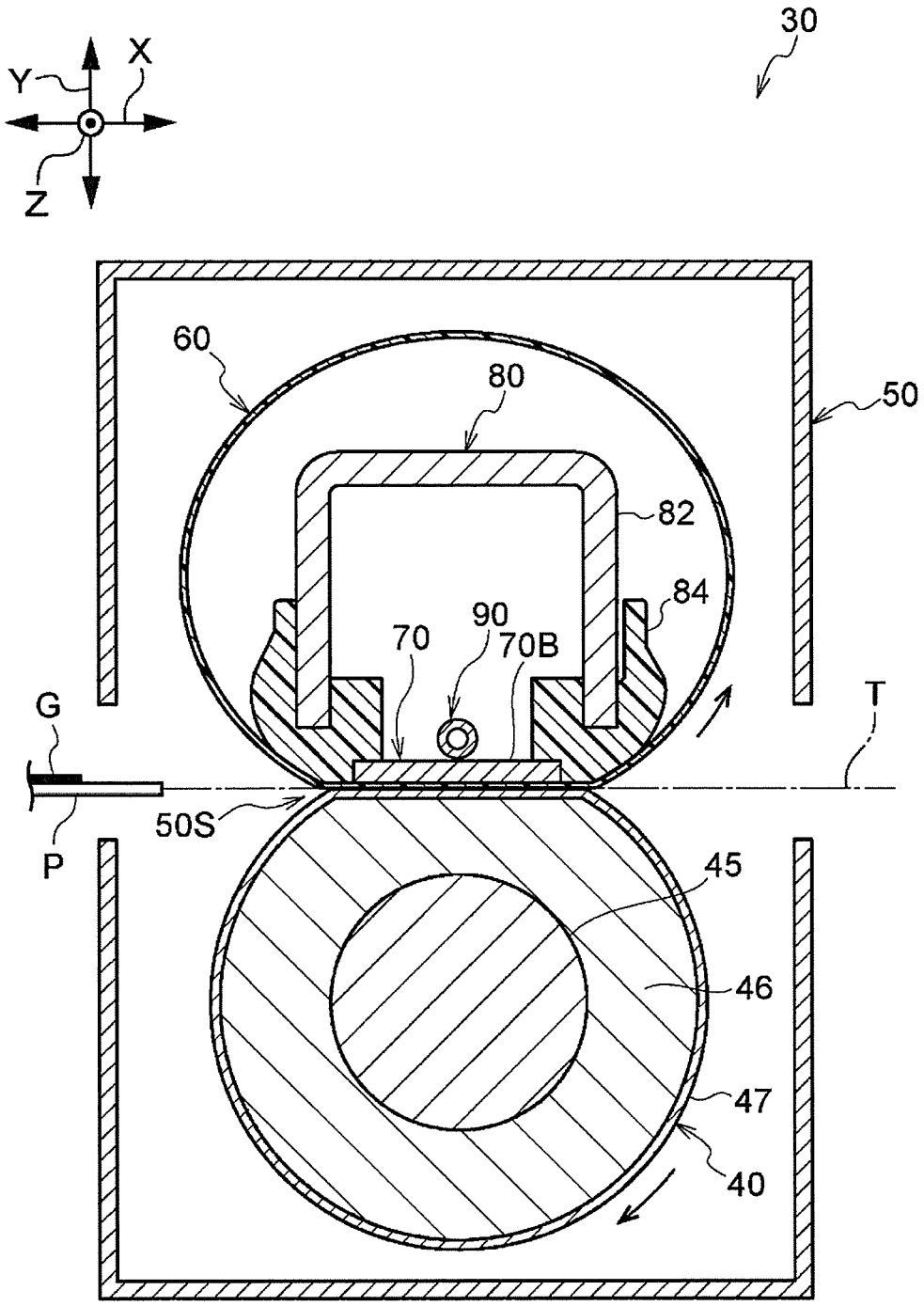
FIG. 2 schematically illustrates the configuration of a fixing device according to this exemplary embodiment.

The fixing device 30 shown in FIG. 1 is an example of a heating device. The fixing device 30 heats the toner image G formed on the sheet P by the image forming unit 16, so as to fix the toner image G onto the sheet P. In detail, as shown in FIG. 1, the fixing device 30 has a device body 50, a pressing roller 40, and a heating belt 60. Furthermore, as shown in FIG. 2, the fixing device 30 has a heater 70, a supporter 80, and heat pipes 90. These components of the fixing device 30 will be described below in detail.

Device Body 50

The device body 50 shown in FIG. 1 is detachable from the apparatus body 11 of the image forming apparatus 10. Accordingly, the entire fixing device 30 is detachable from the apparatus body 11 of the image forming apparatus 10. The device body 50 has a support frame (not shown) that supports the individual components of the fixing device 30.

Pressing Roller 40 and Heating Belt 60

The pressing roller 40 is an example of a rotating unit. The heating belt 60 is an example of a transport belt. The pressing roller 40 and the heating belt 60 are disposed facing each other. The heating belt 60 is annular, specifically, endless. For example, the heating belt 60 is a polyimide-resin member with a fluorine-coated outer peripheral surface. The opposite ends of the heating belt 60 in the belt width direction are rotatably supported by a support member (not shown).

The belt width direction intersects with (specifically, orthogonal to) a rotational direction in which the heating belt 60 rotates, and is parallel to the Z direction. This belt width direction may also be regarded as a direction parallel to a rotational axis (also referred to as "axial direction" hereinafter) of the pressing roller 40.

The pressing roller 40 has a shaft 45 whose axial direction is aligned with the apparatus depth direction (i.e., the Z direction), an elastic layer 46 provided around the outer periphery of the shaft 45, and a separation layer 47 provided around the outer periphery of the elastic layer 46. The shaft 45 is pressed toward the heater 70 by a presser including a spring (not shown). Accordingly, a contact region 50S (i.e., a fixation nip) where the heating belt 60 and the pressing roller 40 are in contact with each other is formed. In other words, the contact region 50S is formed between the heating belt 60 and the pressing roller 40.

Furthermore, with regard to the pressing roller 40, the shaft 45 is supported by a bearing (not shown) and is rotated by a driver (not shown). On the other hand, the heating belt 60 rotates by being driven by the pressing roller 40. Accordingly, the heating belt 60 rotates together with the pressing roller 40 while nipping the sheet P together with the pressing roller 40, thereby transporting the sheet P. This sheet P is pressed by the pressing roller 40 and the heating belt 60 and is also heated by the heater 70, so that the toner image G formed on the sheet P is fixed thereon.

The center of the pressing roller 40 in the axial direction and the center of the heating belt 60 in the belt width direction are substantially aligned with each other. Furthermore, the sheet P is transported by the heating belt 60 and the pressing roller 40 in a state (i.e., a center registered state) where the center of the sheet P in the belt width direction is substantially aligned with the center of the pressing roller 40 in the axial direction and the center of the heating belt 60 in the belt width direction.

Heater 70

As shown in FIG. 2, the heater 70 is disposed inside the heating belt 60 and is supported by the supporter 80 to be described later. The heater 70 has a planar shape (i.e., a tabular shape) whose thickness direction is aligned with the apparatus width direction (i.e., the Y direction), and extends longitudinally in the belt width direction (i.e., the Z direction) of the heating belt 60. The center of the heater 70 in the belt width direction is substantially aligned with the center of the heating belt 60 in the belt width direction.

Figure 3:
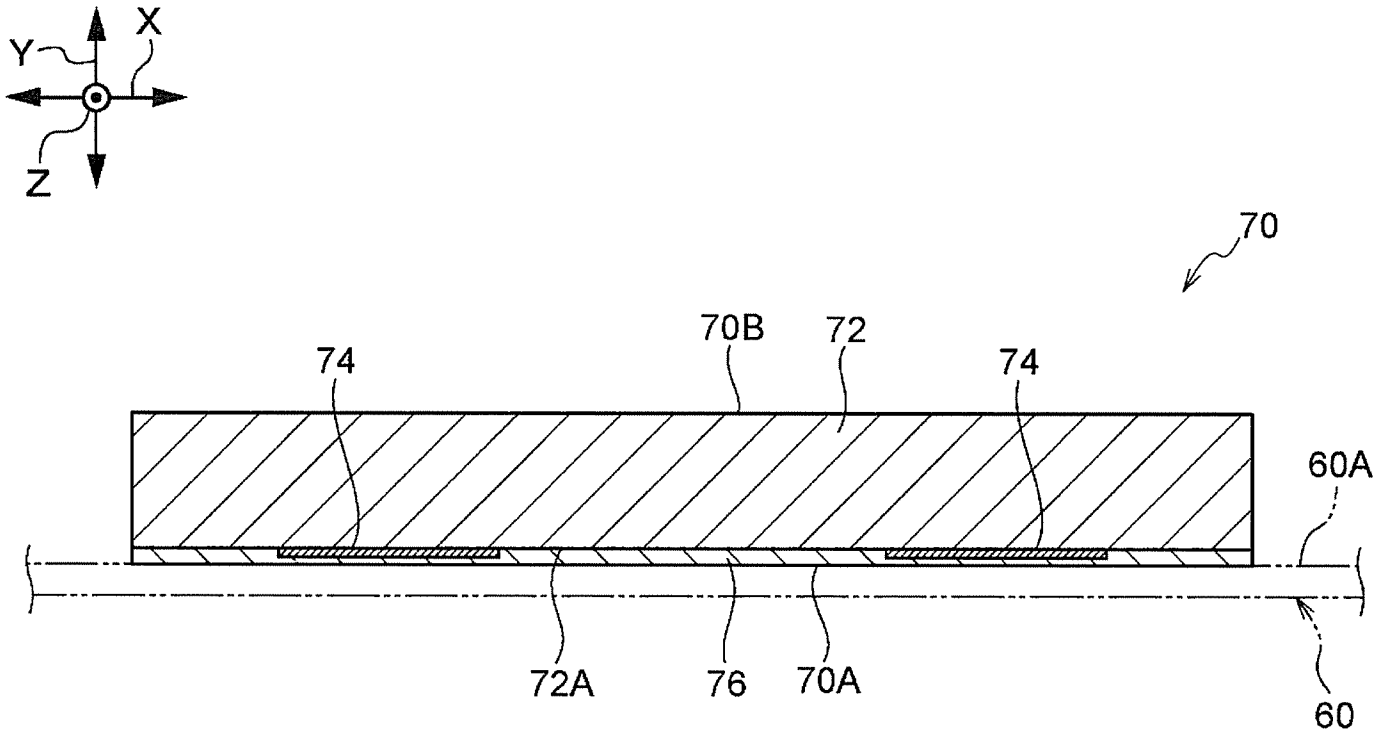
FIG. 3 schematically illustrates the configuration of a heater according to this exemplary embodiment.

As shown in FIG. 3, the heater 70 has a contact surface 70A in contact with an inner peripheral surface 60A of the heating belt 60, and also has a flat non-contact surface 70B not in contact with the inner peripheral surface 60A. The non-contact surface 70B is disposed at the opposite side from the heating belt 60 relative to the contact surface 70A. In other words, the non-contact surface 70B is opposed to the contact surface 70A. Moreover, the non-contact surface 70B is disposed parallel to the contact surface 70A. Specifically, the distance between the non-contact surface 70B and the contact surface 70A is fixed in the apparatus height direction (i.e., the X direction).

Furthermore, as shown in FIG. 3, the heater 70 has a substrate 72, a resistor 74, and a protection layer 76. The substrate 72 is formed of a rectangular plate that is long in the apparatus depth direction (i.e., the Z direction) and short in the apparatus height direction (i.e., the X direction). The substrate 72 is formed of, for example, an alumina molded body. The thickness of the substrate 72 in the apparatus width direction (i.e., the Y direction) for example, about 1 mm.

The resistor 74 is provided on a surface 72A at the pressing roller 40 side of the substrate 72. The opposite ends of the resistor 74 in the apparatus depth direction are provided with electrodes (not shown). The electrodes are connected to a power supply (not shown). Electricity is applied to the resistor 74 from the power supply, so that Joule heat occurs in accordance with an internal resistance of the resistor 74, whereby the resistor 74 generates heat.

The protection layer 76 is provided on the surface 72A of the substrate 72 and covers the resistor 74. This protection layer 76 serves as the contact surface 70A of the heater 70. In the heater 70, the sheet P is heated via the heating belt 60 by the heat generated by the resistor 74.

Supporter 80

The supporter 80 shown in FIG. 2 has a function of supporting the heating belt 60. Moreover, the supporter 80 has a function of supporting the heater 70. In detail, the supporter 80 has a support frame 82 and a retaining member 84.

The support frame 82 extends longitudinally in the apparatus depth direction (i.e., the Z direction). When viewed from the apparatus depth direction, the support frame 82 has a U shape in cross section that has an opening facing toward the pressing roller 40. Furthermore, the opposite ends of the support frame 82 in the apparatus depth direction are supported by the device body 50.

The retaining member 84 is, for example, a crystal polymer member extending longitudinally in the apparatus depth direction. Furthermore, the retaining member 84 is attached to a pressing-side section of the support frame 82 and retains the heater 70.

Heat Pipes 90

Figure 4:
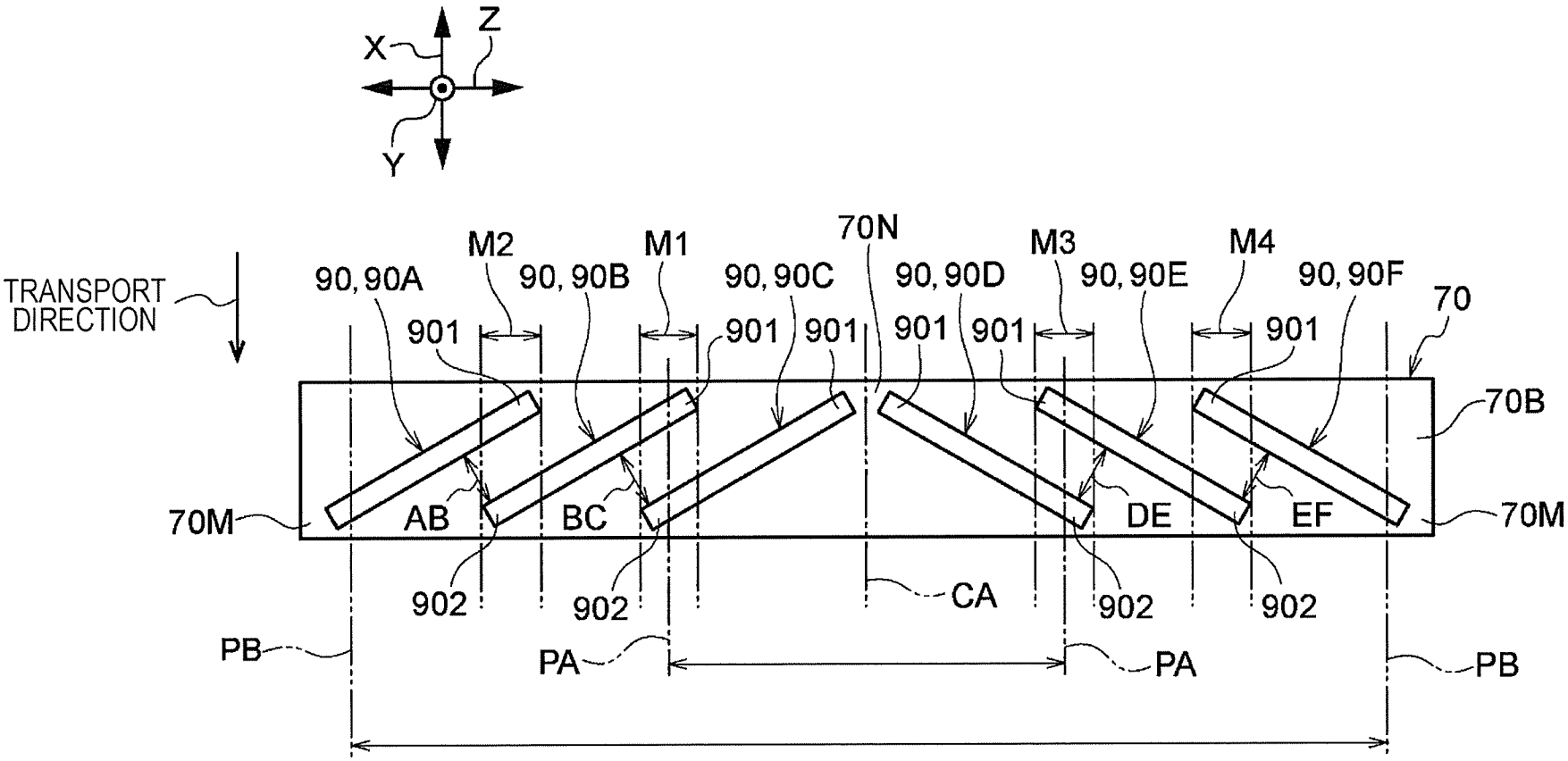
FIG. 4 is a plan view illustrating the configuration of the heater and heat pipes according to this exemplary embodiment.

The heat pipes 90 shown in FIGS. 2 and 4 are arranged in an oblique direction relative to the belt width direction (i.e., the Z direction) of the heating belt 60 and are in contact with the non-contact surface 70B of the heater 70. As shown in FIG. 4, the heat pipes 90 are multiple pipes arranged in the belt width direction.

In this exemplary embodiment, the multiple heat pipes 90 include, for example, six heat pipes 90A, 90B, 90C, 90D, 90E, and 90F. The heat pipes 90A, 90B, 90C, 90D, 90E, and 90F are arranged in this order from one side to the other side in the belt width direction. In this exemplary embodiment, all the heat pipes 90 are arranged in the oblique direction relative to the belt width direction of the heating belt 60.

As viewed in a direction orthogonal to the non-contact surface 70B (referred to as "orthogonal view" hereinafter), first ends 901 of the heat pipes 90C and 90D extend toward each other in the belt width direction, whereas second ends 902 thereof extend away from each other in the belt width direction. Specifically, the heat pipes 90C and 90D are arranged in an inverted-V-like pattern in the orthogonal view.

In detail, the heat pipes 90C and 90D are arranged in the inverted-V-like pattern such that the first ends 901 thereof extend toward each other in the belt width direction at the entry side of the sheet P (referred to as "sheet entry side" hereinafter). Specifically, the heat pipes 90C and 90D are arranged in the inverted-V-like pattern such that the first ends 901 extend toward each other in the belt width direction at the upstream side in the transport direction of the sheet P and that the second ends 902 extend away from each other in the belt width direction at the downstream side in the transport direction of the sheet P.

More specifically, the heat pipes 90C and 90D are arranged in the inverted-V-like pattern such that the first ends 901 extend toward each other in the belt width direction at the center of the non-contact surface 70B in the belt width direction. The first ends 901 of the heat pipes 90C and 90D are separated from each other in the belt width direction. Specifically, the heat pipes 90C and 90D do not overlap each other, as viewed in the belt circumferential direction (i.e., the X direction). In FIG. 4, the center of the non-contact surface 70B in the belt width direction is indicated by a single-dot chain line CA.

The first end 901 of each heat pipe 90 is a first end in the axial direction as well as a first end in the belt circumferential direction. Moreover, the first end 901 of each heat pipe 90 is also a first end in the belt width direction. The second end 902 of each heat pipe 90 is a second end in the axial direction as well as a second end in the belt circumferential direction. Moreover, the second end 902 of each heat pipe 90 is also a second end in the belt width direction.

In this exemplary embodiment, the heat pipes 90A and 90B are arranged along the heat pipe 90C. In detail, the heat pipes 90A and 90B are arranged parallel to the heat pipe 90C. More specifically, a distance AB between the heat pipes 90A and 90B and a distance BC between the heat pipes 90B and 90C are equal to each other. In other words, the heat pipes 90A, 90B, and 90C have the same arrangement density in the belt width direction.

The first end 901 of the heat pipe 90B overlaps the heat pipe 90C, as viewed in the belt circumferential direction. In detail, the first end 901 of the heat pipe 90B overlaps the second end 902 of the heat pipe 90C, as viewed in the belt circumferential direction. This overlapping range is indicated by an arrow M1 in FIG. 4.

The second end 902 of the heat pipe 90B overlaps the heat pipe 90A, as viewed in the belt circumferential direction. In detail, the second end 902 of the heat pipe 90B overlaps the first end 901 of the heat pipe 90A, as viewed in the belt circumferential direction. This overlapping range is indicated by an arrow M2 in FIG. 4.

Furthermore, in this exemplary embodiment, the heat pipes 90E and 90F are arranged along the heat pipe 90D. In detail, the heat pipes 90E and 90F are arranged parallel to the heat pipe 90D. More specifically, a distance DE between the heat pipes 90D and 90E and a distance EF between the heat pipes 90E and 90F are equal to each other. In other words, the heat pipes 90D, 90E, and 90F have the same arrangement density in the belt width direction.

The first end 901 of the heat pipe 90E overlaps the heat pipe 90D, as viewed in the belt circumferential direction. In detail, the first end 901 of the heat pipe 90E overlaps the second end 902 of the heat pipe 90D, as viewed in the belt circumferential direction. This overlapping range is indicated by an arrow M3 in FIG. 4.

The second end 902 of the heat pipe 90E overlaps the heat pipe 90F, as viewed in the belt circumferential direction. In detail, the second end 902 of the heat pipe 90E overlaps the first end 901 of the heat pipe 90F, as viewed in the belt circumferential direction. This overlapping range is indicated by an arrow M4 in FIG. 4.

Furthermore, the heat pipes 90C and 90D are arranged astride passing positions PA where minimum-width edges, in the belt width direction, of the sheet P transported through the fixing device 30 pass. In this exemplary embodiment, the heat pipes 90B and 90E are also arranged astride the passing positions PA. In other words, one of the passing positions PA is located within the range M1 where the first end 901 of the heat pipe 90B and the second end 902 of the heat pipe 90C overlap. The other one of the passing positions PA is located within the range M3 where the first end 901 of the heat pipe 90E and the second end 902 of the heat pipe 90D overlap.

Moreover, the heat pipes 90A and 90F are arranged astride passing positions PB where maximum-width edges, in the belt width direction, of the sheet P transported through the fixing device 30 pass.

The heat pipes 90 are arranged as described above, so that the heat pipes 90 are arranged in line symmetry with respect to the single-dot chain line CA serving as a symmetry axis.

Figure 5:
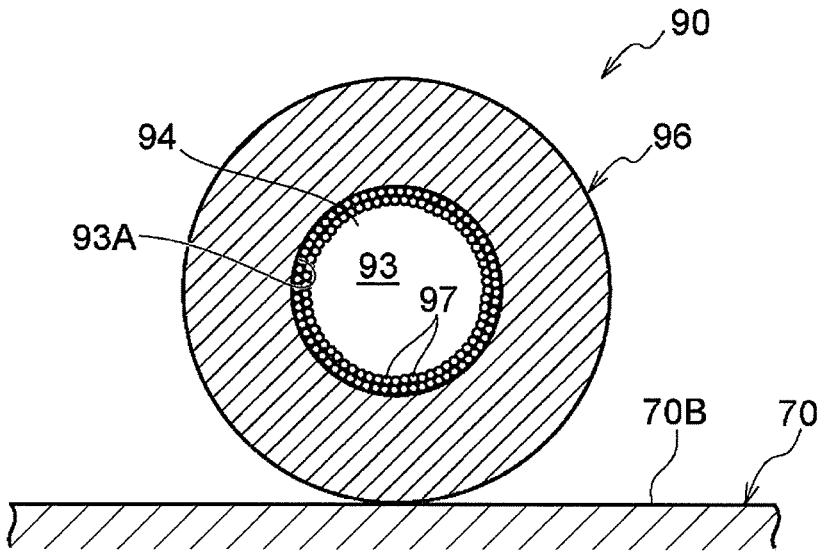
FIG. 5 is a cross-sectional view illustrating the configuration of each heat pipe according to this exemplary embodiment.

Furthermore, as shown in FIG. 5, each heat pipe 90 includes a cylindrical pipe body 96 and wires 97. An interior 94 of each heat pipe 90 is provided with a cross-sectionally-circular space 93 filled with a working fluid. The space 93 extends in the axial direction of the heat pipe 90. The space 93 is filled with the working fluid in a state where the space 93 is decompressed.

The wires 97 shown in FIG. 5 serve as a forming member that forms a capillary tube that causes the working fluid to move in the axial direction. The wires 97 are disposed in the space 93 in the heat pipe 90. In detail, the wires 97 are a bundle of multiple wires disposed in the space 93 and extending in the axial direction of the heat pipe 90. Accordingly, in this exemplary embodiment, a capillary structure (i.e., a so-called wick) is formed by the wires 97.

Due to the function of the working fluid enclosed in the interior 94, the heat pipe 90 transfers heat in the belt width direction of the heating belt 60. In detail, the heat of the heater 70 is transferred as follows. The working fluid is boiled by heat applied to the heat pipe 90 by a high temperature section of the heater 70. Vapor of the working fluid generated as a result of the boiling moves to a low temperature section of the heater 70 in accordance with a pressure difference. The vapor condenses at the low temperature section, so that condensation heat is released to the heater 70. Then, the condensed working fluid is returned to the original position (i.e., the high temperature section of the heater 70) in accordance with a capillary phenomenon caused by the capillary tube formed by the wires 97.

Operation According to Exemplary Embodiment

Next, the operation according to this exemplary embodiment will be described.

In the image forming apparatus according to this exemplary embodiment, the image forming unit 16 forms a toner image G onto a sheet P transported by the transport unit 14, as shown in FIG. 1. In the fixing device 30, the toner image G formed on the sheet P by the image forming unit 16 is pressed by the pressing roller 40 and the heating belt 60 and is heated by the heater 70, so as to become fixed onto the sheet P.

In this exemplary embodiment, when a temperature distribution occurs in the heater 70, each heat pipe 90 transfers heat from the high temperature section to the low temperature section of the heater 70 in accordance with the function of the working fluid enclosed in the interior 94.

A temperature distribution of the heater 70 occurs when, for example, a toner image G is fixed onto a sheet P having a dimension smaller than that of the heater 70 in the belt width direction. In this case, the heat is surrendered to the sheet P in an area of the heater 70 in the belt width direction, so that a temperature distribution occurs in the heater 70.

As shown in FIG. 4, in this exemplary embodiment, the heat pipes 90 are arranged in the oblique direction relative to the belt width direction of the heating belt 60 and are in contact with the non-contact surface 70B of the heater 70.

In a configuration where the heat pipes 90 are disposed to extend in the belt width direction (referred to as "first configuration" hereinafter), the heat of the heater 70 is transferred in the belt width direction by the heat pipes 90, so that a temperature distribution in the heater 70 in the belt width direction is eliminated. However, a temperature distribution in the heater 70 in the belt circumferential direction remains and is less likely to be eliminated.

In contrast, in this exemplary embodiment, the heat pipes 90 are arranged in the oblique direction relative to the belt width direction of the heating belt 60, as shown in FIG. 4, so that heat is transferred also in the belt circumferential direction. Therefore, in this exemplary embodiment, temperature variations in the heater 70 may be reduced in the belt width direction and the belt circumferential direction, as compared with the first configuration. Accordingly, in the fixing device 30, fixation variations of the toner image G onto the sheet P may be reduced in the belt width direction and the belt circumferential direction.

Furthermore, in this exemplary embodiment, the heat pipes 90 are multiple heat pipes arranged in the belt width direction. Therefore, temperature variations in the heater 70 may be reduced in the belt width direction and the belt circumferential direction, as compared with a configuration where a single heat pipe 90 is disposed.

Moreover, in this exemplary embodiment, the first end 901 of the heat pipe 90B overlaps the heat pipe 90C, as viewed in the belt circumferential direction. In detail, the first end 901 of the heat pipe 90B overlaps the second end 902 of the heat pipe 90C, as viewed in the belt circumferential direction (see the arrow M1 in FIG. 4).

In a configuration where the heat pipes 90B and 90C are disposed away from each other in the belt width direction (referred to as "second configuration" hereinafter), a blank region with no heat pipes 90 disposed therein is formed between the heat pipe 90B and the heat pipe 90C. Since heat is not transferred by a heat pipe 90 in the belt width direction in this blank region, temperature variations in the heater 70 are less likely to be eliminated. In contrast, in this exemplary embodiment, the first end 901 of the heat pipe 90B overlaps the heat pipe 90C, as viewed in the belt circumferential direction, so that temperature variations in the heater 70 may be reduced in the belt width direction and the belt circumferential direction, as compared with the second configuration.

Furthermore, in this exemplary embodiment, the first end 901 of the heat pipe 90E overlaps the heat pipe 90D, as viewed in the belt circumferential direction. With this configuration, effects similar to those described above may be exhibited.

Moreover, in this exemplary embodiment, the second end 902 of the heat pipe 90B overlaps the heat pipe 90A, as viewed in the belt circumferential direction. In detail, the second end 902 of the heat pipe 90B overlaps the first end 901 of the heat pipe 90A, as viewed in the belt circumferential direction (see the arrow M2 in FIG. 4).

Therefore, temperature variations in the heater 70 may be reduced in the belt width direction and the belt circumferential direction, as compared with a configuration in which a blank region where heat is not transferred by a heat pipe 90 in the belt width direction is not formed between the heat pipe 90B and the heat pipe 90A such that only the first end of the heat pipe 90B overlaps a heat pipe 90.

Furthermore, in this exemplary embodiment, the second end 902 of the heat pipe 90E overlaps the heat pipe 90F, as viewed in the belt circumferential direction. With this configuration, effects similar to those described above may be exhibited.

Moreover, in this exemplary embodiment, the heat pipes 90C and 90D are arranged in the inverted-V-like pattern in the orthogonal view such that the first ends 901 thereof extend toward each other in the belt width direction and that the second ends 902 thereof extend away from each other in the belt width direction.

Therefore, a space formed between the second ends 902 of the heat pipes 90C and 90D is larger than a space between the first ends 901 thereof. Consequently, in this exemplary embodiment, a sufficient space for arranging a component therein may be ensured, as compared with a configuration where the multiple heat pipes 90 are all arranged parallel to one another. An example of such a component includes a temperature sensor that measures the temperature of the heater 70.

Furthermore, in detail, the heat pipes 90C and 90D are arranged in the inverted-V-like pattern such that the first ends 901 thereof extend toward each other in the belt width direction at the sheet entry side of the heater 70 in this exemplary embodiment. More specifically, the heat pipes 90C and 90D are arranged in the inverted-V-like pattern such that the first ends 901 thereof extend toward each other in the belt width direction at the center of the non-contact surface 70B in the belt width direction. Therefore, heat is transferrable to the center in the belt width direction at the sheet entry side of the heater 70 (i.e., at the upstream side in the transport direction). Consequently, for example, in a case where opposite ends 70M, in the belt width direction, of the heater 70 at the downstream side in the transport direction are defined as a high temperature section and a center 70N, in the belt width direction, of the heater 70 at the upstream side in the transport direction is defined as a low temperature section, heat is efficiently transferred from the high temperature section to the low temperature section. In the fixing device 30, the temperature at the center 70N of the heater 70 at the upstream side in the transport direction is maintained, so that a decrease in fixability of a toner image G may be suppressed.

Furthermore, in this exemplary embodiment, the heat pipes 90C and 90D are arranged astride the passing positions PA where minimum-width edges, in the belt width direction, of the sheet P transported through the fixing device 30 pass.

Figure 6:
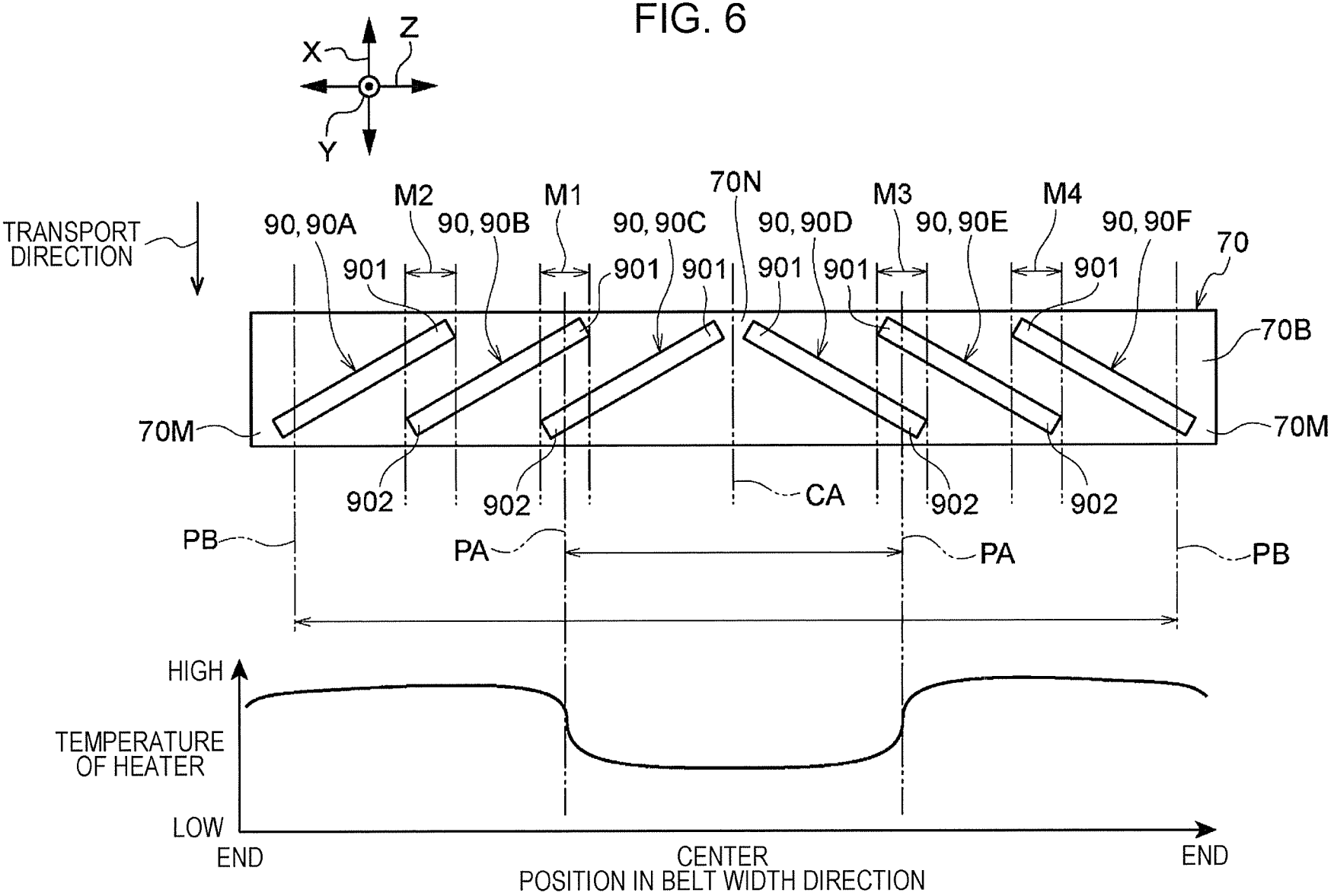
FIG. 6 schematically illustrates a temperature distribution of the heater according to this exemplary embodiment.

In a case where a toner image G is to be fixed onto a sheet P of a minimum width, heat is surrendered to the sheet P in a range HA between the passing positions PA, as shown in FIG. 6, so that the temperature of the heater 70 decreases in the range HA.

In contrast, in this exemplary embodiment, since the heat pipes 90C and 90D are arranged astride the passing positions PA, heat is transferred inward from outside the range HA, so that temperature variations in the heater 70 may be reduced.

Modification of Arrangement Density of Heat Pipes 90

Figure 7:
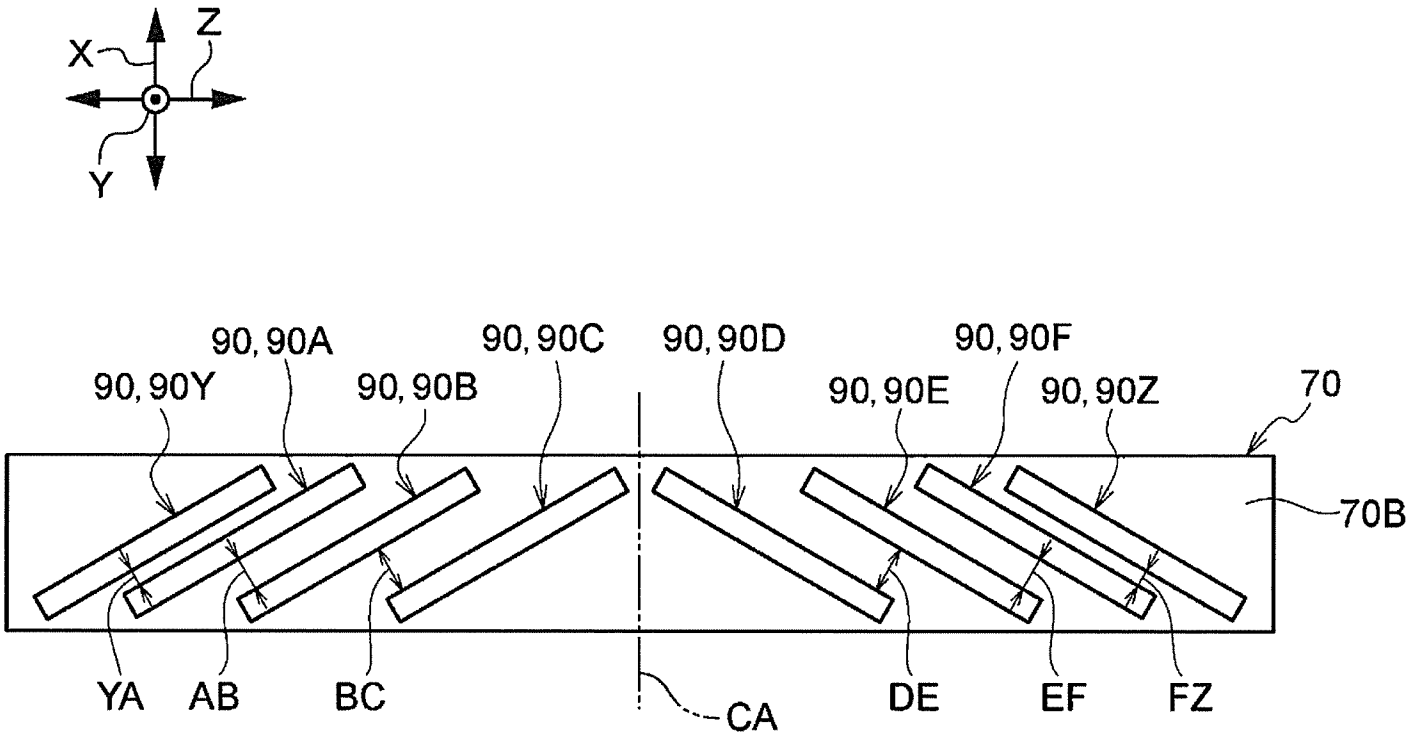
FIG. 7 is a plan view illustrating a modification in which the arrangement density of the heat pipes according to this exemplary embodiment has been changed.

In this exemplary embodiment, the heat pipes 90A, 90B, and 90C have the same arrangement density in the belt width direction, and the heat pipes 90D, 90E, and 90F have the same arrangement density in the belt width direction. Alternatively, for example, the distance between multiple heat pipes 90 arranged from the center to each end of the heater 70 in the belt width direction may gradually decrease, as shown in FIG. 7. In the configuration shown in FIG. 7, a distance BC between the heat pipes 90B and 90C, a distance AB between the heat pipes 90A and 90B, and a distance YA between the heat pipe 90A and a heat pipe 90Y gradually decrease in this order. Moreover, a distance DE between the heat pipes 90D and 90E, a distance EF between the heat pipes 90E and 90F, and a distance FZ between the heat pipe 90F and a heat pipe 90Z gradually decrease in this order. In other words, in the configuration shown in FIG. 7, the arrangement density of the multiple heat pipes 90 is higher at each end of the heater 70 in the belt width direction than at the center thereof in the belt width direction. Accordingly, the arrangement density of the multiple heat pipes 90 may be varied in the belt width direction.

MODIFICATIONS

As an alternative to this exemplary embodiment in which the wires 97 are used as a forming member that forms a capillary tube for moving the working fluid in the axial direction, for example, a mesh member may be used as a forming member, so long as the member forms a capillary tube.

As an alternative to this exemplary embodiment in which multiple heat pipes 90 are provided in the heater 70, a single heat pipe 90 may be provided in the heater 70.

Figure 8:
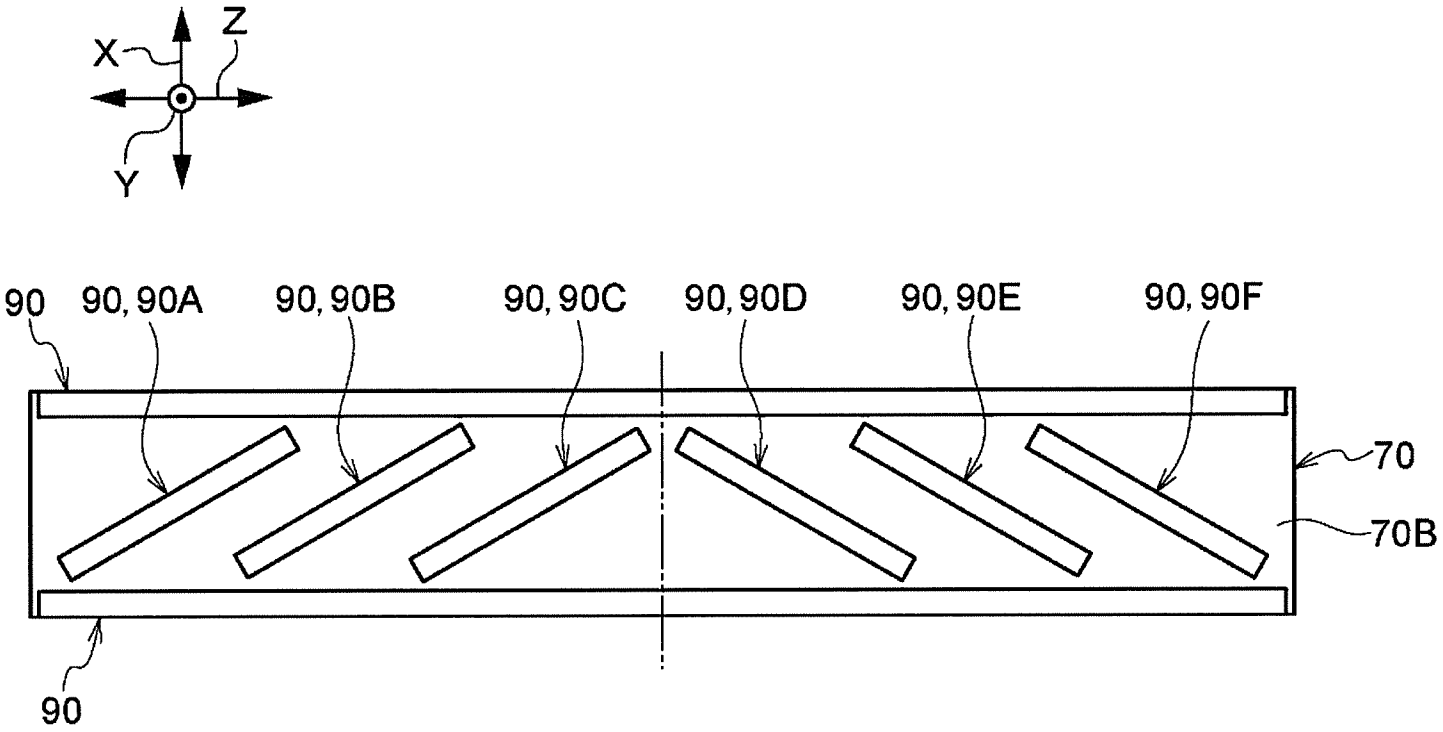
FIG. 8 is a plan view illustrating a modification in which heat pipes disposed to extend in the belt width direction have been added to the configuration shown in FIG. 4.

As an alternative to this exemplary embodiment in which all the heat pipes 90 are arranged in the oblique direction relative to the belt width direction of the heating belt 60, for example, heat pipes 90 disposed to extend in the belt width direction may be additionally provided, as shown in FIG. 8. In the configuration shown in FIG. 8, the heat pipes 90 disposed to extend in the belt width direction are disposed at the sheet entry side of the heater 70 (i.e., the upstream side in the transport direction) and at the sheet exit side of the heater 70 (i.e., the downstream side in the transport direction).

Furthermore, as an alternative to this exemplary embodiment in which the first end 901 of the heat pipe 90B overlaps the heat pipe 90C and the second end 902 of the heat pipe 90B overlaps the heat pipe 90A, as viewed in the belt circumferential direction, for example, only one of the first end 901 and the second end 902 of the heat pipe 90B may overlap another heat pipe 90. Moreover, for example, the heat pipe 90B may be disposed away, in the belt width direction, from heat pipes 90 adjacent thereto in the belt width direction (i.e., the heat pipes 90A and 90C).

Furthermore, as an alternative to this exemplary embodiment in which the first end 901 of the heat pipe 90E overlaps the heat pipe 90D and the second end 902 of the heat pipe 90E overlaps the heat pipe 90F, as viewed in the belt circumferential direction, for example, only one of the first end 901 and the second end 902 of the heat pipe 90E may overlap another heat pipe 90. Moreover, for example, the heat pipe 90E may be disposed away, in the belt width direction, from heat pipes 90 adjacent thereto in the belt width direction (i.e., the heat pipes 90D and 90F).

Furthermore, as an alternative to this exemplary embodiment in which the heat pipes 90C and 90D are arranged in the inverted-V-like pattern such that the first ends 901 thereof extend toward each other in the belt width direction at the center of the non-contact surface 70B in the belt width direction, for example, an inverted-V-like pattern in which the first ends 901 extend toward each other in the belt width direction at an end of the non-contact surface 70B in the belt width direction (i.e., at a position offset from the center in the belt width direction) is also possible. Even in this case, it is desirable that the first ends 901 of the heat pipes 90C and 90D be located within the range HA between the passing positions PA where the minimum-width edges of the sheet P pass.

Furthermore, as an alternative to this exemplary embodiment in which the heat pipes 90C and 90D are arranged in the inverted-V-like pattern such that the first ends 901 thereof extend toward each other in the belt width direction at the sheet entry side of the heater 70 (i.e., at the upstream side in the transport direction), for example, the heat pipes 90C and 90D may be arranged in an inverted-V-like pattern such that the first ends 901 thereof extend toward each other in the belt width direction at the sheet exit side of the heater 70 (i.e., at the downstream side in the transport direction).

Furthermore, the heat pipes 90A, 90B, and 90C may be arranged along the heat pipe 90D. Moreover, the heat pipes 90D, 90E, and 90F may be arranged along the heat pipe 90C. Specifically, the multiple heat pipes 90 may all be arranged in the same oblique direction.

The present disclosure is not limited to the above-described exemplary embodiment and permits various modifications, alterations, and improvements within the scope of the disclosure. For example, multiple modifications of the modifications described above may be combined, where appropriate.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The exemplary embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A heating device comprising:

a rotating unit that rotates;

a transport belt that rotates together with the rotating unit while nipping a heated member together with the rotating unit so as to transport the heated member;

a heater that has a contact surface in contact with an inner peripheral surface of the transport belt and a non-contact surface not in contact with the inner peripheral surface of the transport belt, and that generates heat so as to heat the heated member via the transport belt; and at least one heat pipe that is disposed in an oblique direction relative to a belt width direction of the transport belt such that the at least one heat pipe is in contact with the non-contact surface of the heater, and that transfers heat in the oblique direction in accordance with a function of a working fluid enclosed inside the at least one heat pipe.

2. The heating device according to claim 1, wherein the at least one heat pipe includes a plurality of heat pipes arranged in the belt width direction.

3. The heating device according to claim 2, wherein each of the heat pipes is disposed such that a first end in the belt width direction overlaps another heat pipe, as viewed in a belt circumferential direction of the transport belt.

4. The heating device according to claim 3, wherein the heat pipe with the first end overlapping another heat pipe is disposed such that a second end in the belt width direction overlaps another heat pipe, as viewed in the belt circumferential direction of the transport belt.

5. The heating device according to claim 4, wherein the at least one heat pipe is disposed astride a passing position where minimum-width edges, in the belt width direction, of the heated member transported through the heating device pass.

6. The heating device according to claim 3, wherein the at least one heat pipe is disposed astride a passing position where minimum-width edges, in the belt width direction, of the heated member transported through the heating device pass.

7. The heating device according to claim 2, wherein, as viewed in a direction orthogonal to the non-contact surface, the plurality of heat pipes are arranged in a pattern where first ends thereof in a belt circumferential direction extend toward each other in the belt width direction and second ends thereof in the belt circumferential direction extend away from each other in the belt width direction.

8. The heating device according to claim 7, wherein the plurality of heat pipes are arranged in the pattern such that the first ends thereof in the belt circumferential direction extend toward each other in the belt width direction at a side from which the heated member enters.

9. The heating device according to claim 8, wherein the plurality of heat pipes are arranged in the pattern such that the first ends thereof in the belt circumferential direction extend toward each other in the belt width direction at a center of the non-contact surface in the belt width direction.

10. The heating device according to claim 9, wherein the at least one heat pipe is disposed astride a passing position where minimum-width edges, in the belt width direction, of the heated member transported through the heating device pass.

11. The heating device according to claim 8, wherein the at least one heat pipe is disposed astride a passing position where minimum-width edges, in the belt width direction, of the heated member transported through the heating device pass.

12. The heating device according to claim 7, wherein the at least one heat pipe is disposed astride a passing position where minimum-width edges, in the belt width direction, of the heated member transported through the heating device pass.

13. The heating device according to claim 2, wherein the at least one heat pipe is disposed astride a passing position where minimum-width edges, in the belt width direction, of the heated member transported through the heating device pass.

14. The heating device according to claim 1, wherein the at least one heat pipe is disposed astride a passing position where minimum-width edges, in the belt width direction, of the heated member transported through the heating device pass.

15. An image forming apparatus comprising:

an image forming unit that forms an image onto a recording medium as a heated member; and the heating device according to claim 1 that fixes the image onto the recording medium by heating.

* * * * *